US012662273B2

(12) United States Patent
Linnig et al.

(10) Patent No.: US 12,662,273 B2
(45) Date of Patent: Jun. 23, 2026

(54) SYSTEM AND METHOD FOR FORMING A SLEEVE OF PAPER WRAPPING MATERIAL AROUND A LOAD

(71) Applicant: Signode Industrial Group LLC, Tampa, FL (US)

(72) Inventors: Kimnoah Pascal Linnig, Haderslev (DK); Flemming B. Olsen, Haderslev (DK); Alice Holm-Kristensen, Sydals (DK)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 19/109,871

(22) PCT Filed: Sep. 8, 2023

(86) PCT No.: PCT/US2023/073704
§ 371 (c)(1),
(2) Date: Mar. 7, 2025

(87) PCT Pub. No.: WO2024/059463
PCT Pub. Date: Mar. 21, 2024

(65) Prior Publication Data

US 2026/0077890 A1 Mar. 19, 2026

Related U.S. Application Data

(60) Provisional application No. 63/375,566, filed on Sep. 14, 2022.

(51) Int. Cl.
*B65B 11/10* (2006.01)
*B65B 11/00* (2006.01)
(Continued)

(52) U.S. Cl.
CPC ..... *B65B 11/10* (2013.01); *B65B 41/16* (2013.01); *B65B 51/02* (2013.01); *B65B 61/06* (2013.01); *B65B 2011/002* (2013.01)

(58) Field of Classification Search
CPC ..... B65B 11/10; B65B 41/16; B65B 51/02; B65B 61/06; B65B 2011/002; B65H 23/025; B65H 23/02; B65H 2408/2173
See application file for complete search history.

(56) References Cited

U.S. PATENT DOCUMENTS 2,741,885 A * 4/1956 Allison ..... B29C 65/7433 53/526
3,564,810 A * 2/1971 Name not available ..... B29C 66/431 100/17

(Continued)

FOREIGN PATENT DOCUMENTS

CN 101903251 A 12/2010
DE 2614558 A1 10/1977

(Continued)

OTHER PUBLICATIONS

International Search Report and Written Opinion from PCT/US2023/073704, Feb. 16, 2024.

*Primary Examiner* — Dariush Seif
(74) *Attorney, Agent, or Firm* — Neal, Gerber & Eisenberg LLP

(57) ABSTRACT

Various embodiments of the present disclosure provide a system and method for forming a sleeve of paper wrapping material around a load of goods.

19 Claims, 11 Drawing Sheets

(51) Int. Cl.

| | |
|---|---|
| ***B65B 41/16*** | (2006.01) |
| ***B65B 51/02*** | (2006.01) |
| ***B65B 61/06*** | (2006.01) |

(56) References Cited

U.S. PATENT DOCUMENTS 3,590,549 A * 7/1971 Zelnick ..... B65B 53/02 53/442
3,662,512 A * 5/1972 Zelnick ..... B65B 53/066 53/442
3,672,116 A * 6/1972 Ingmarson ..... B65B 9/026 53/586
3,841,057 A * 10/1974 Engeler ..... B65B 41/16 53/228
3,884,016 A * 5/1975 Bostrom ..... B65B 9/026 53/553
3,950,203 A 4/1976 Van der Wal
3,965,652 A 6/1976 Cimins
3,994,114 A * 11/1976 Nishimura ..... B65B 11/585 53/374.3
3,994,116 A * 11/1976 McCormick ..... B65B 9/026 53/228
RE29,362 E * 8/1977 Reid ..... B65B 9/026 53/232
4,167,841 A * 9/1979 Camp ..... B65B 9/026 53/399
4,173,313 A * 11/1979 Rogers ..... B65H 16/103 242/534
4,211,349 A 7/1980 van der Wal
4,313,288 A * 2/1982 Tassi ..... B65B 41/16 53/553
4,319,443 A * 3/1982 Watts, Jr. ..... B65B 9/026 53/553
4,366,021 A 12/1982 van der Wal
4,413,463 A * 11/1983 Lancaster ..... B65B 9/026 53/399
4,499,706 A * 2/1985 Scheller ..... B65D 71/0096 53/399
4,509,314 A * 4/1985 Bozza ..... B65B 11/10 53/586
4,563,859 A * 1/1986 Visser ..... B65B 9/026 53/553
4,628,668 A * 12/1986 Wildmoser ..... B65B 9/026 53/399
4,712,354 A 12/1987 Lancaster et al.
4,724,652 A 2/1988 Birkenfeld
4,724,658 A 2/1988 Birkenfeld et al.
4,738,078 A * 4/1988 Benz ..... B65B 11/10 53/228
4,782,648 A 11/1988 Van Ottele
4,831,812 A * 5/1989 Martin Cocher ..... B65B 9/026 53/399
5,129,211 A * 7/1992 Andersson ..... B65D 71/08 53/399
5,177,932 A * 1/1993 Schmetzer ..... B31F 5/025 53/550
5,187,922 A * 2/1993 Mast ..... B65B 9/026 53/64
5,509,253 A * 4/1996 Cappi ..... B65B 59/001 53/504
5,528,881 A * 6/1996 Cappi ..... B65B 11/54 53/464
5,595,042 A * 1/1997 Cappi ..... B65B 11/54 53/64
5,603,198 A * 2/1997 Rimondi ..... B65B 11/54 53/228
5,620,151 A * 4/1997 Ueyama ..... B65H 19/30 242/533.8
5,653,093 A * 8/1997 Delledonne ..... B65B 11/54 53/556
5,657,608 A * 8/1997 Parviainen ..... B65B 11/10 53/465
5,848,756 A * 12/1998 Sollinger ..... B65H 18/00 242/541.4
5,980,676 A * 11/1999 Meetze ..... B65H 83/02 156/247
6,021,711 A 2/2000 Van Ottele
6,032,439 A 3/2000 Birkenfeld et al.
6,038,832 A * 3/2000 Focke ..... B65B 51/023 53/53
6,085,487 A * 7/2000 De Vlaam ..... B65B 27/08 100/17
6,223,500 B1 * 5/2001 Kramps ..... B65B 11/10 53/399
6,470,654 B1 10/2002 Lachenmeier et al.
6,598,379 B2 7/2003 Zitella et al.
6,658,819 B2 * 12/2003 Gamberini ..... B65B 25/14 53/436
6,766,625 B2 * 7/2004 Cinotti ..... B65B 11/12 53/376.5
7,503,153 B2 * 3/2009 De Matteis ..... B65B 11/10 53/223
7,823,368 B2 * 11/2010 Hansen ..... B65B 63/02 53/529
7,913,476 B2 3/2011 Lachenmeier
7,937,910 B2 5/2011 Jaconelli et al.
9,003,744 B2 * 4/2015 Hannen ..... B65B 11/585 53/170
9,623,989 B2 * 4/2017 Loevenich ..... B65B 5/06
9,764,867 B2 9/2017 Lachenmeier et al.
10,011,383 B2 7/2018 Suolahti et al.
10,279,937 B2 5/2019 Frenzel et al.
10,526,097 B2 1/2020 Lachenmeier et al.
10,538,354 B2 1/2020 Hannen et al.
10,618,680 B2 * 4/2020 Hung ..... B65B 9/026
10,696,506 B2 6/2020 Hannen et al.
10,974,857 B2 4/2021 Hannen et al.
11,097,860 B2 8/2021 Lorenzen et al.
11,097,865 B2 * 8/2021 Fenn ..... B65B 11/02
11,267,595 B2 * 3/2022 Wetsch ..... B32B 27/32
11,434,030 B2 9/2022 Meng
11,814,205 B2 * 11/2023 Lancaster, III .... B65H 23/1888
11,884,434 B2 * 1/2024 Dahlmanns ..... B29C 65/224
11,999,515 B2 * 6/2024 Wetsch ..... B65B 25/00
12,060,192 B2 8/2024 Olsen et al.
12,344,420 B2 * 7/2025 Bergen ..... B65B 61/06
2004/0251370 A1 * 12/2004 Solberg ..... B29C 48/08 242/615.11
2004/0255557 A1 * 12/2004 Shanklin ..... B65B 11/54 53/553
2005/0284783 A1 12/2005 May
2006/0053750 A1 3/2006 Petersen
2006/0059864 A1 3/2006 White et al.
2006/0096244 A1 * 5/2006 Cere' ..... B65B 9/026 53/399
2007/0057103 A1 * 3/2007 Malecot ..... B65H 19/2276 242/525
2008/0229716 A1 9/2008 Zitella et al.
2012/0096814 A1 * 4/2012 Hannen ..... B65B 9/026 53/461
2013/0067864 A1 * 3/2013 Dwyer ..... B65B 11/10 53/449
2014/0230380 A1 * 8/2014 Geerts ..... B65B 9/135 53/556
2015/0307290 A1 10/2015 Khn et al.
2016/0264271 A1 * 9/2016 Knoblauch ..... B65B 51/303
2018/0105298 A1 4/2018 Frenzel
2018/0305049 A1 * 10/2018 Wetsch ..... B32B 3/02
2019/0071199 A1 * 3/2019 Cassoli ..... B65B 59/003
2019/0152632 A1 5/2019 Lorenzen et al.
2021/0188467 A1 6/2021 Bocedi et al.
2021/0237916 A1 8/2021 Christel
2022/0185516 A1 * 6/2022 Wetsch ..... B65B 9/026
2023/0020790 A1 * 1/2023 Bergen ..... B65B 57/02

FOREIGN PATENT DOCUMENTS

DE 3941139 A1 6/1991
DE 4440217.1 C1 5/1996

(56) References Cited

FOREIGN PATENT DOCUMENTS

| | | | |
|---|---|---|---|
| DE | 102009020454 | B3 | 10/2010 |
| DE | 102011103366 | B3 | 9/2012 |
| DE | 102015011766 | A1 | 3/2017 |
| EP | 1574432 | A1 | 9/2005 |
| EP | 1520784 | B1 | 2/2006 |
| EP | 2036818 | A1 | 3/2009 |
| EP | 2248722 | A1 | 11/2010 |
| EP | 3885110 | A1 | 9/2021 |
| EP | 3924258 | A1 | 12/2021 |
| ES | 2747425 | B2 | 10/2020 |
| FR | 3069232 | A1 | 1/2019 |
| KR | 102140430 | B1 | 8/2020 |
| PL | 238867 | B1 | 10/2021 |
| WO | 8203833 | A1 | 11/1982 |
| WO | 2005042346 | A1 | 5/2005 |
| WO | 2009068294 | A1 | 6/2009 |
| WO | 2021018557 | A1 | 2/2021 |
| WO | 2021058850 | A1 | 4/2021 |

* cited by examiner

SYSTEM AND METHOD FOR FORMING A SLEEVE OF PAPER WRAPPING MATERIAL AROUND A LOAD

PRIORITY

This application is a national phase application of PCT/US2023/073704, filed on Sep. 8, 2023, which claims priority to and the benefit of U.S. Provisional Patent Application No. 63/375,566, filed Sep. 14, 2022, the entire contents of which is incorporated herein by reference.

FIELD

The present disclosure relates to a system and method for wrapping a load with paper wrapping material, and more particularly to a system and method for forming a sleeve of the paper wrapping material around the load.

BACKGROUND

Packaging lines include one or more of several different types of unitizing systems that unitize a load of goods by securing the goods together and, in certain applications, to a pallet. These unitizing systems include stretch-wrapping machines that use rolls of plastic stretch film to unitize a load of goods. Typical stretch-wrapping machines include a film carriage on which a replaceable roll of stretch film is mounted. To wrap the load of goods, the film carriage rotates relative to the load or the load rotates relative to the film carriage (depending on the type of stretch-wrapping machine) while the film carriage vertically moves relative to the load. This relative movement pulls the stretch film from the roll and applies it to the load in a spiral pattern.

While stretch-wrapping machines are proven stalwarts in the industry, there is a desire to, where appropriate, reduce the use of plastic stretch film without negatively affecting the unitization of the load. Paper wrapping material is one recyclable, eco-friendly alternative to plastic stretch film. There is a continuing need for new systems for wrapping loads of goods with paper wrapping material.

SUMMARY

Various embodiments of the present disclosure provide a system and method for forming a sleeve of paper wrapping material around a load of goods.

One method for forming a sleeve of paper wrapping material around a load includes applying paper wrapping material to a leading surface of the load by engaging the leading surface with paper wrapping material extending from a paper wrapping material roll to a first roller on one side of the load and from the first roller to a second roller on an opposite side of the load; applying paper wrapping material to opposing first and second side surfaces of the load, wherein applying paper wrapping material to the second side surface comprises unwinding part of a length of paper wrapping material wound around the second roller; and applying paper wrapping material to a trailing surface of the load to form the sleeve of paper wrapping material.

DETAILED DESCRIPTION

Figure 1A:
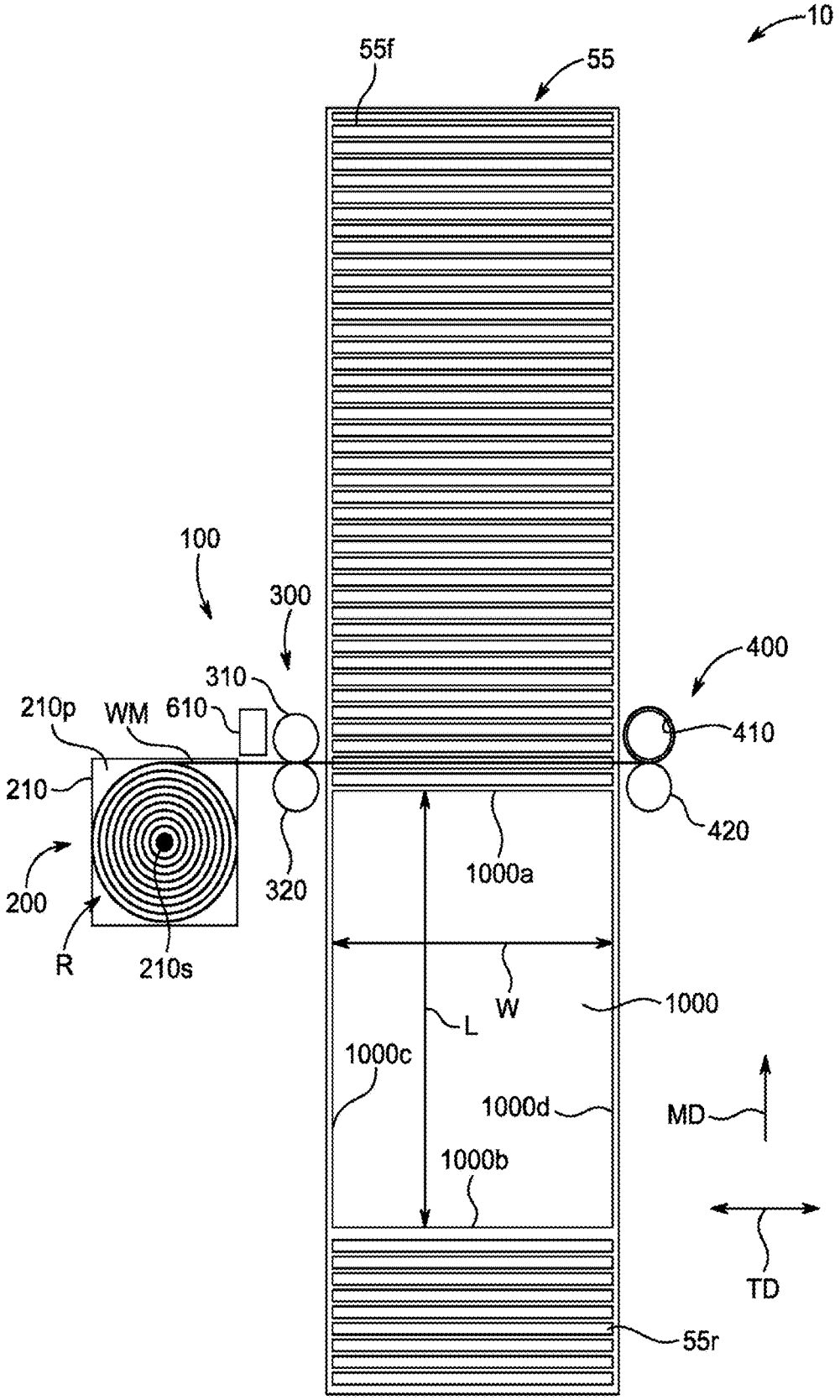
FIGS. 1A-1J are diagrammatic top plan views of the wrapping system of the present disclosure forming a sleeve of paper wrapping material around a load of goods.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 1B:
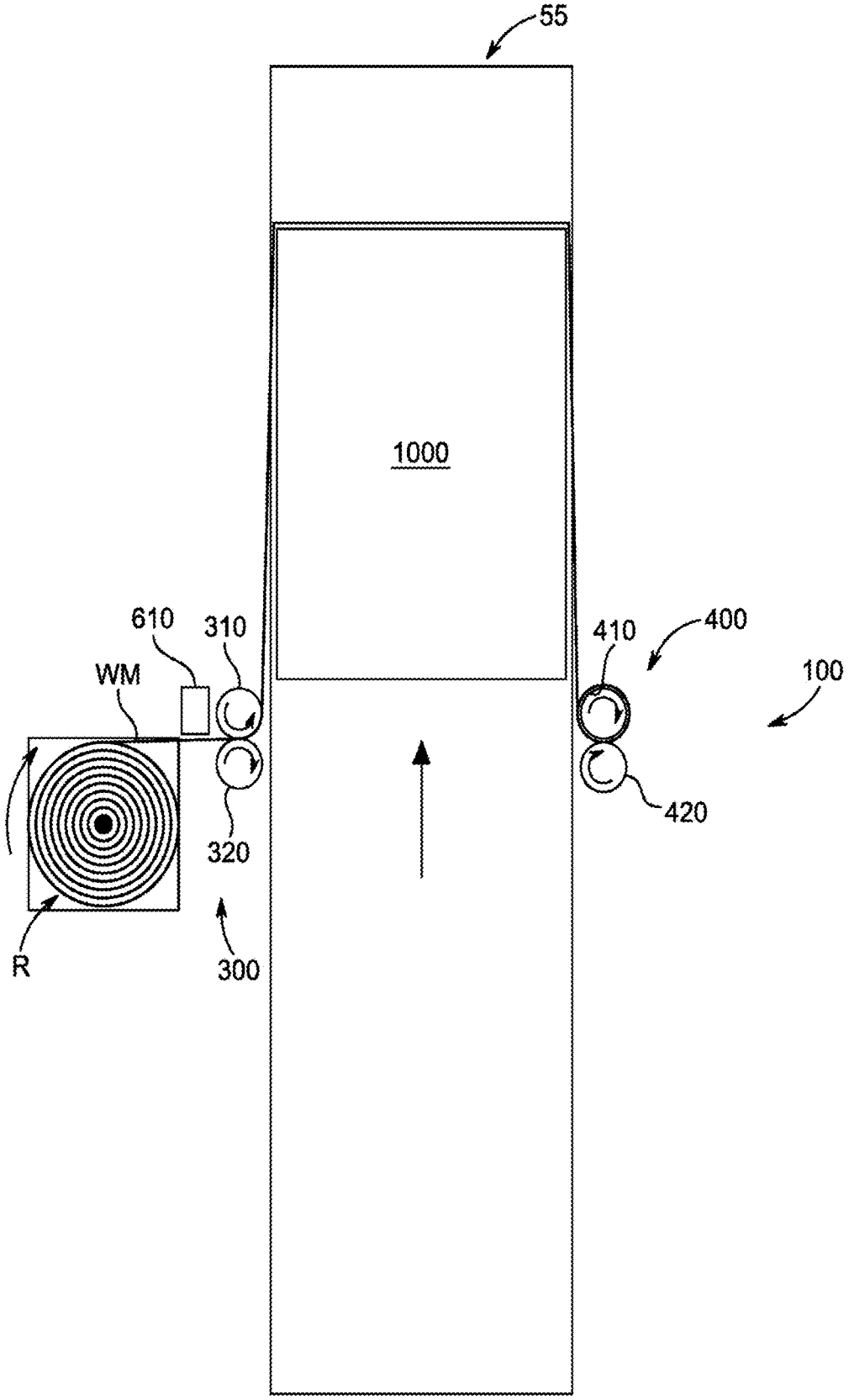

Various embodiments of the present disclosure provide a system and method for drawing paper wrapping material from a roll and forming a sleeve of the paper wrapping material around a load of goods. FIGS. 1A-2 show one embodiment of the paper wrapping system 10 of the present disclosure and the assemblies and components of the wrapping system 10. The wrapping system 10 includes a conveyor system (not labeled) and a wrapping device 100.

The conveyor system supports a load and moves the load in a movement direction MD (FIG. 1A) relative to and between certain components of the wrapping device 100 as the wrapping device 100 forms a sleeve of the paper wrapping material WM around the load. The conveyor system includes a conveyor 55 and one or more conveyor actuators **55*a* operably connected to the conveyor 55 and configured to drive the conveyor 55. Specifically, the conveyor 55 includes a conveyor frame 55*f* and multiple aligned rollers 55*r* rotatably supported by the conveyor frame 55*f*. The rollers 55*r* are not shown in FIGS. 1B-1J for clarity. The one or more conveyor actuators 55*a*, which include one or more electric motors in this example embodiment but may include any suitable type of actuator(s), is operably connected to the conveyor rollers 55*r* through a suitable drive train—such as via gearing, chains, belts, and the like—and is configured to drive the conveyor rollers 55*r***. The conveyor may include one or more driven belts or any other suitable type of driven component instead of or in addition to drive rollers.

The wrapping device 100 forms a sleeve of the paper wrapping material WM around a load as the conveyor system moves the load relative to and through the wrapping device 100. The wrapping device 100 includes a roll-support assembly 200, a first roller assembly 300, a second roller assembly 400, a gripper assembly, an adhesive-applicator assembly, a cutter assembly, a controller 900, and one or more sensors S.

The roll-support assembly 200 supports and drives the roll R of paper wrapping material WM during the wrapping process. The roll-support assembly 200 includes a roll support 210 and a roll actuator **210*a*. The roll support 210** includes a platform 210*p* and a spindle 210*s* extending from and rotatable relative to the platform 210*p*. The platform 210*p* is sized, shaped, oriented, positioned, and otherwise configured to support the roll R. The spindle 210*s* is sized, shaped, oriented, positioned, and otherwise configured such that the central core of the roll R of the paper wrapping material WM can be slid onto the spindle 210*s* and fixed in rotation with the spindle 210*s* such that the roll R can rotate with the spindle 210*s* relative to the platform 210*p*. In certain embodiments, the spindle 210*s* includes radially outwardly biased friction members configured to fix the roll R in rotation with the spindle 210*s* via friction fit, though any other suitable manner may be employed. The roll actuator 210*a*, which includes an electric motor in this example embodiment but may be any other suitable actuator, is operably connected to the spindle 210*s* and configured to rotate the spindle 210*s-and* a roll R mounted to the spindle 210*s-relative* to the platform 210*p*. The roll-support assembly 200 is positioned next to the conveyor system.

The first roller assembly 300 manipulates the paper wrapping material WM during the wrapping process and, after the wrapping process is complete, feeds paper wrapping material WM to the second roller assembly 400 in preparation for the next wrapping process. The first roller assembly 300 includes a cylindrical first drive roller 310, a first-drive-roller actuator 310*a*, a cylindrical first idle roller 320, a first-roller-assembly actuator 300*a*, and a first-roller-assembly support (not shown for clarity). The first drive roller 310 and the first idle roller 320 are vertically oriented (into and out of the page from the perspective shown in FIGS. 1A-1J) and rotatably mounted to the first-roller-assembly support. A first biasing member (not shown), such as one or more springs, biases the first idle roller 320 into contact with the first drive roller 310. The first-drive-roller actuator 310*a*, which includes an electric motor in this example embodiment but may be any other suitable actuator, is operably connected to the first drive roller 310 and configured to rotate the first drive roller 310 relative to the first idle roller 320. The first idle roller 320, on the other hand, is freely rotatable (undriven) in this example embodiment. The first-roller-assembly actuator 300*a*, which includes an electric motor in this example embodiment but may be any other suitable actuator, is operably connected to the first drive roller 310 and the first idle roller 320 (such as via the first-roller-assembly support) and configured to move the first drive roller 310 and the first idle roller 320 in a transverse direction TD that is transverse to (and here, perpendicular to) the movement direction MD relative to the conveyor system (and any load on it), the roll-support assembly 200 (and any roll R thereon), and the second roller assembly 400.

The second roller assembly 400 manipulates the paper wrapping material WM during the wrapping process and, after the wrapping process is complete, receives and stores paper wrapping material WM from the first roller assembly 300 in preparation for the next wrapping process. The second roller assembly 300 includes a cylindrical second drive roller 410, a second-drive-roller actuator 410*a*, a cylindrical second idle roller 420, a second-roller-assembly actuator 400*a*, and a second-roller-assembly support (not shown for clarity). The second drive roller 410 and the second idle roller 420 are vertically oriented (into and out of the page from the perspective shown in FIGS. 1A-1J) and rotatably mounted to the second-roller-assembly support. A second biasing member (not shown), such as one or more springs, biases the second idle roller 420 into contact with the second drive roller 410. The second-drive-roller actuator 410*a*, which includes an electric motor in this example embodiment but may be any other suitable actuator, is operably connected to the second drive roller 410 and configured to rotate the second drive roller 410 relative to the second idle roller 420. The second idle roller 420, on the other hand, is freely rotatable (undriven) in this example embodiment. The second-roller-assembly actuator 400*a*, which includes an electric motor in this example embodiment but may be any other suitable actuator, is operably connected to the second drive roller 410 and the second idle roller 420 (such as via the second-roller-assembly support) in the transverse direction TD relative to the conveyor system (and any load on it), the roll-support assembly 200 (and any roll R thereon), and the first roller assembly 300.

The gripper assembly grips the paper wrapping material WM to hold it in place during certain stages of the wrapping process to facilitate forming the sleeve. The gripper assembly includes a gripper 510 and a gripper actuator 510*a*. The gripper 510 includes any suitable device, such as a pair of movable fingers, actuatable between a gripping configuration in which the gripper 510 grips the paper wrapping material WM and a release configuration in which the gripper 510 releases the paper wrapping material WM. The gripper actuator 510*a* includes one or more actuators, such as one or more electric motors, configured to: (1) actuate the gripper 510 between its gripping and release configurations; and (2) move the gripper 510 into position so the gripper 510 can grip the paper wrapping material WM. This embodiment of the gripper assembly includes a single gripper, but other embodiments may include any suitable quantity of grippers, such as one gripper positioned and otherwise configured to grip a top edge of the wrapping material and another gripper positioned and otherwise configured to grip a bottom edge of the wrapping material.

The adhesive-applicator assembly applies adhesive to a portion of the paper wrapping material WM to facilitate forming the sleeve. The adhesive-applicator assembly includes an adhesive applicator 610 and an adhesive-applicator actuator 610*a*. The adhesive applicator 610 may be any suitable device actuatable to apply any suitable type of adhesive to the paper wrapping material WM. In this example embodiment, the adhesive applicator 610 includes a tape dispenser configured to apply double-sided adhesive tape to the paper wrapping material. In other embodiments, the adhesive applicator includes a sprayer or a roller configured to spray liquid adhesive onto the paper wrapping material. The adhesive-applicator actuator 610*a* includes one or more actuators configured to: (1) actuate the adhesive applicator 610 to apply the adhesive; and (2) move the adhesive applicator 610 to facilitate the application of the adhesive, which in this example embodiment involves moving the adhesive applicator vertically relative to the conveyor system (and any load on it), the roll-support assembly 200 (and any roll R thereon), the first roller assembly 300, and the second roller assembly 400.

The cutter assembly cuts the paper wrapping material WM from the roll R. The cutter assembly includes a cutter 710 and a cutter actuator 710*a* operably connected to the cutter 710 to actuate the cutter 710 to cut the paper wrapping material WM. In this example embodiment, the cutter 710 includes a retractable blade housed within the first drive roller 310, and the cutter actuator 710*a* (which is an electric motor in this example embodiment but may be any suitable actuator) is operably connected to the cutter 710 to project the cutter 710 from the first drive roller 310 to cut the paper wrapping material WM.

The sensors S include any suitable sensors (such as encoders) configured to sense rotation of the one or more of the roll R, the first drive roller 310, the first idle roller 320, the second drive roller 410, and the second idle roller 420. In certain embodiments, the sensors include a presence sensor configured to detect whether the paper wrapping material is extending between the roll and the first drive roller. This presence sensor may include an optical sensor or may include a position sensor operably connected to a dancer roller contacting the paper wrapping material extending between the roll and the first drive roller.

The controller 900 includes a processing device communicatively connected to a memory device. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the wrapping system 10 (such as to carry out the wrapping process described below).

The controller 900 is communicatively and operably connected to the conveyor actuator 55*a*, the roll actuator 210*a*, the first-roller-assembly actuator 300*a*, the first-drive-roller actuator 310*a*, the second-roller-assembly actuator 400*a*, the second-drive-roller actuator 410*a*, the gripper actuator 510*a*, the adhesive-applicator actuator 610*a*, the cutter actuator 710*a*, and the sensors S to control operation of and receive signals from these components to carry out the wrapping process described below.

The wrapping system 10 carrying out a wrapping process to form a sleeve 1000*s* of the paper wrapping material WM around a load of goods 1000 is described below with reference to FIGS. 1A-1J. The load 1000 has a length L, a width W, a leading surface 1000*a*, a trailing surface 1000*b* opposite the leading surface 1000*a*, a first side surface 1000*c*, and a second side surface 1000*d* opposite the first side surface 1000*c*. As shown in FIG. 1A, at the start of the wrapping process, the first drive roller 310 and first idle roller 320 are in a home position in which they are between the roll R and the load 1000. Similarly, at the start of the wrapping process, the second drive roller 410 and second idle roller 420 are in a home position on the opposite side of the load 1000 from the first drive and idle rollers and in which they are spaced-apart from the load 1000 in the transverse direction TD. The paper wrapping material WM extends from the roll R, through the nip between the first drive roller 310 and the first idle roller 320, across the conveyor 55 and in front of the leading surface 1000*a* of the load 1000, between the nip between the second drive roller 410 and the second idle roller 420, and around the second drive roller 410. The length of paper wrapping material WM wrapped around the second drive roller 410 is approximately equal to the sum of the length L and half of the width W of the load 1000, though it may be any suitable amount.

The controller 900 controls the conveyor actuator 55*a* to drive the conveyor 55 to move the load 1000 in the movement direction MD relative to the wrapping machine 100 and the paper wrapping material WM. The leading surface 1000*a* of the load 1000 eventually contacts the paper wrapping material WM suspended across the conveyor 55. Continued movement of the load 1000 results in the load pulling paper wrapping material off of the roll R and off of the second drive roller 410, and that paper wrapping material extending along the first and second side surfaces 1000*c* and 1000*d*, respectively, of the load 1000. Once the load 1000 has moved past the first and second drive rollers 310 and 410, as shown in FIG. 1B, the controller 900 controls the conveyor actuator 55*a* to stop driving the conveyor 55. At this point, paper wrapping material WM extends across the leading surface 1000*a* and along the first and second side surfaces 1000*c* and 1000*d* of the load 1000.

Certain types of paper wrapping material, like plastic stretch film, have some amount of elasticity so they are able to be stretched before application to the load to increase the containment force of the sleeve (stretched paper wrapping material will squeeze the load tighter than unstretched paper wrapping material). In certain embodiments in which the paper wrapping material is able to be stretched, during this step the controller 900 controls: (1) the roll actuator 210*a* so the surface speed of the roll R and the linear speed of the paper wrapping material WM exiting the roll is less than the linear speed of the load 1000 in the movement direction MD and/or the first-drive-roller actuator 310*a* so the surface speed of the first drive roller 310 and the linear speed of the paper wrapping material WM exiting the first drive roller 310 is less than the linear speed of the load 1000 in the movement direction MD; and (2) the second-drive-roller actuator 410*a* so the surface speed of the second drive roller 410 and the linear speed of the paper wrapping material WM exiting the second drive roller 410 is less than the linear speed of the load 1000 in the movement direction MD. This speed differential (with the load moving faster than the paper wrapping material being applied to the load) results in the paper wrapping material stretching as it is being applied to the load L, with the amount of stretch varying based on the speed differential (larger differential leads to more stretch).

Figure 1C:
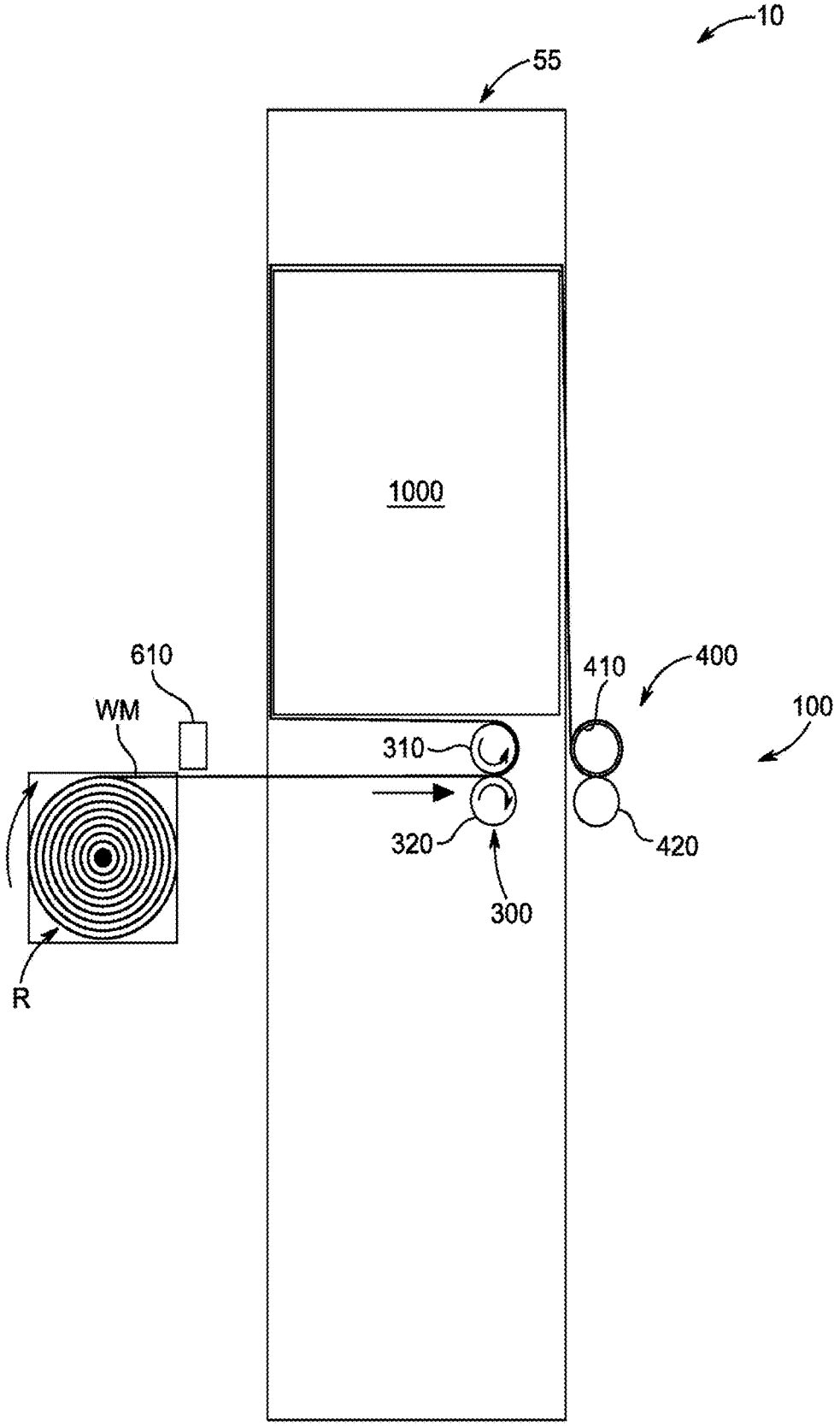
Figure 2:
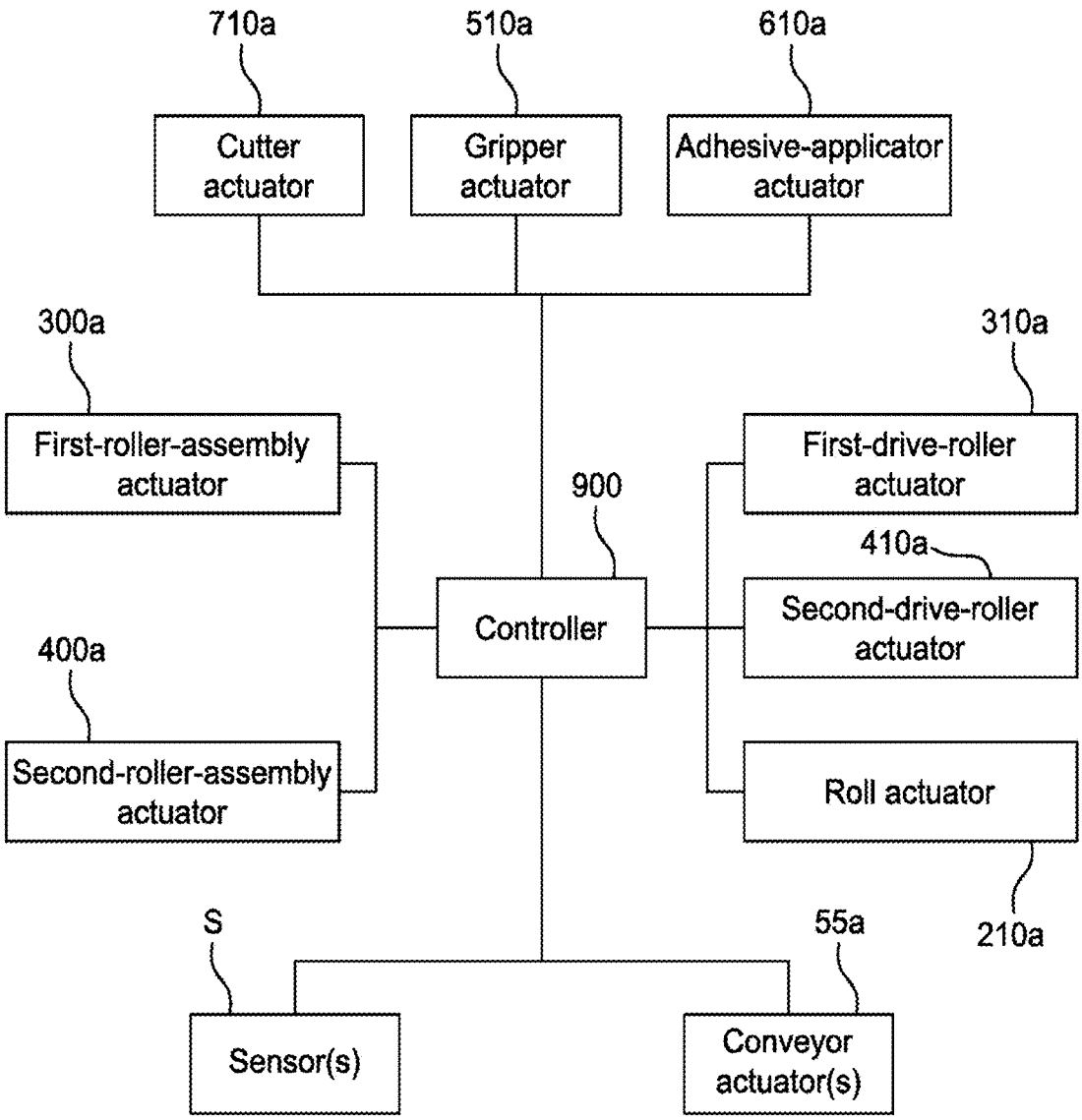
FIG. 2 is a block diagram showing certain components of the wrapping system of FIG. 1.

As shown in FIG. 1C, the controller 900 controls the first-roller-assembly actuator 300*a* to move the first drive roller 310 and the first idle roller 320 in the transverse direction TD from their home position to a sleeving position closer to the second drive roller 410 and the second idle roller 420. During this movement, the first drive roller 310 pulls the paper wrapping material WM from the roll R and across part of the trailing surface 1000*b* of the load 1000.

Figure 1D:
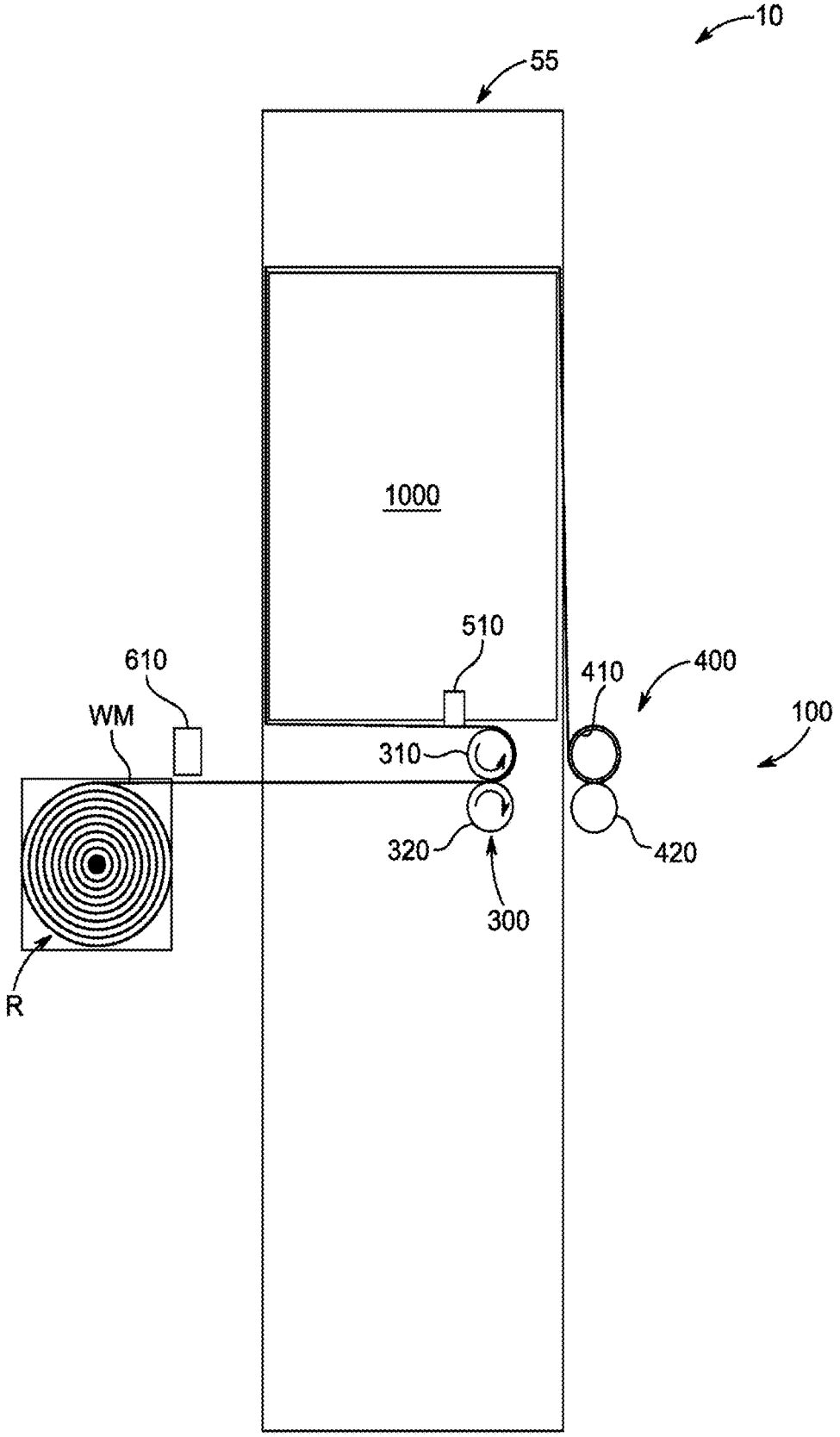

As shown in FIG. 1D, the controller 900 then controls the gripper actuator 510*a* to control the gripper 510 to grip the paper wrapping material WM near where it exits the first drive roller 310. The gripper 510 is not shown in FIG. 1A-1C or 1H-1J for clarity.

Figure 1E:
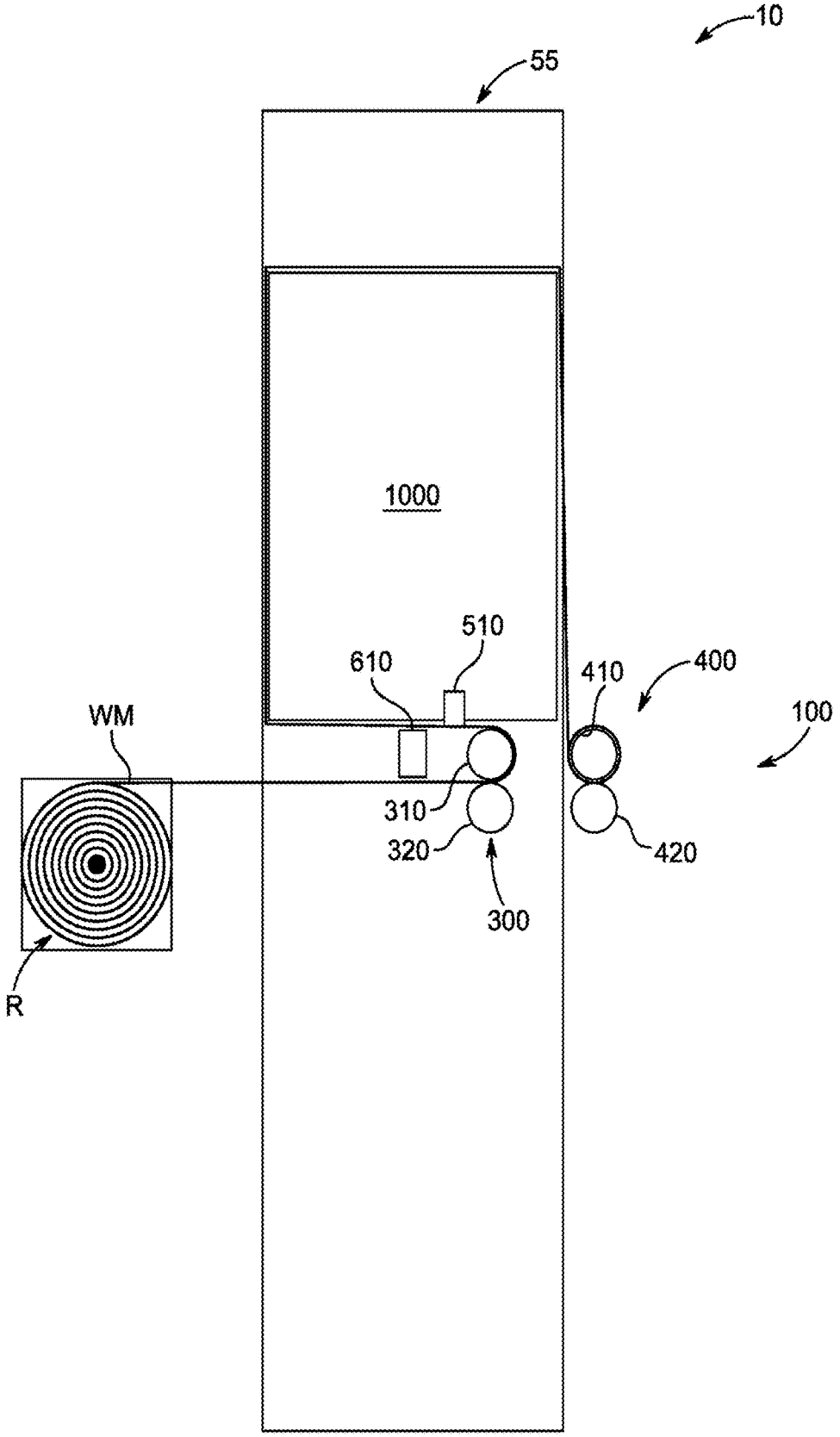

As shown in FIG. 1E, the controller 900 controls the adhesive-applicator actuator 610*a* to move and otherwise control the adhesive applicator 610 to apply adhesive, which is double-sided adhesive tape T in this example embodiment (shown with an exaggerated thickness in FIG. 1F for clarity and not shown in the remaining Figures), to a portion of the paper wrapping material WM extending across the trailing surface 1000*b* of the load 1000. In this example embodiment, the adhesive applicator 610 applies the adhesive to the paper wrapping material near the midpoint of the width of the load 1000.

Figure 1F:
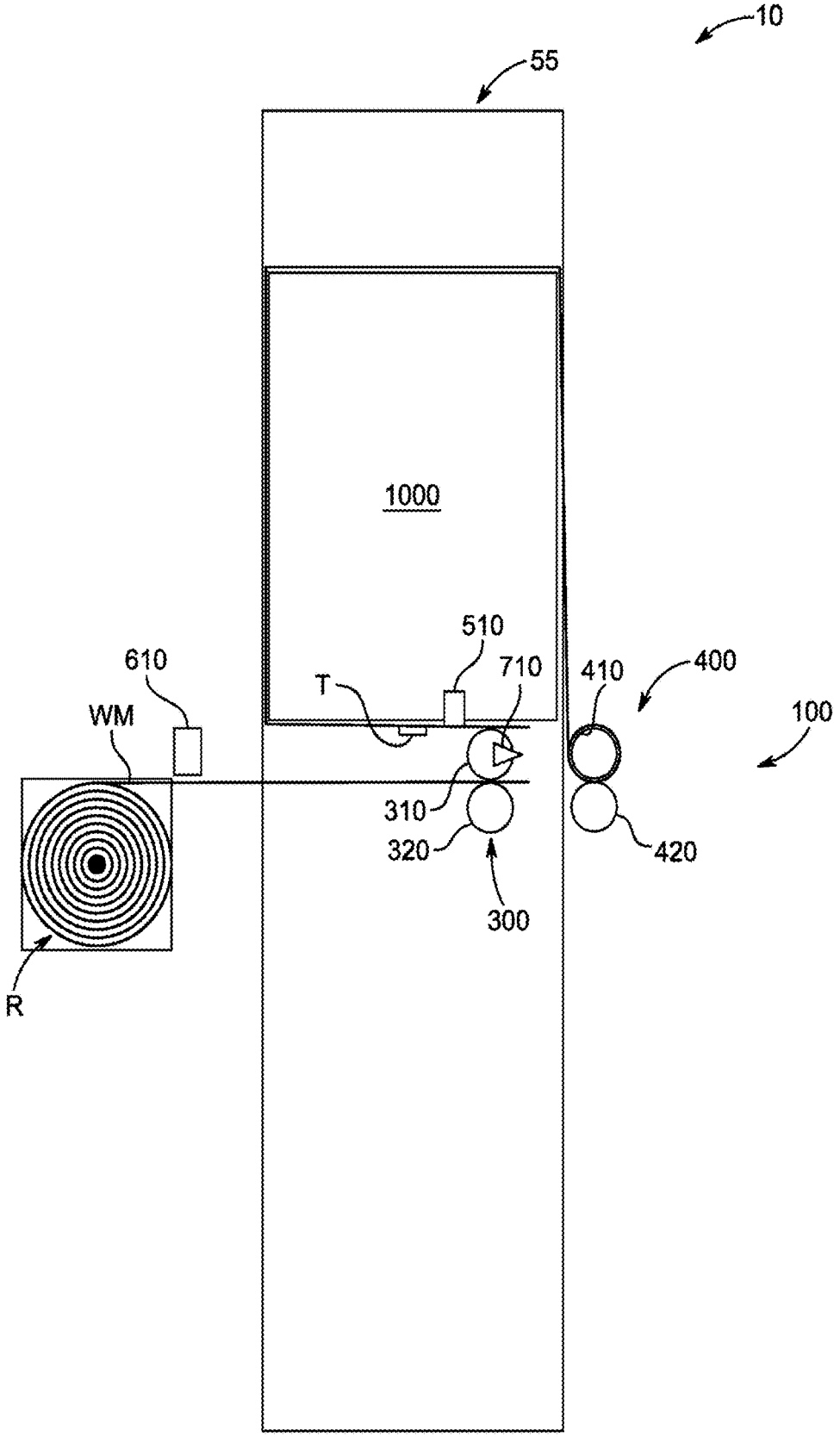

As shown in FIG. 1F, the controller 900 controls the cutter actuator 710*a* to actuate the cutter 710 to cut the paper wrapping material WM from the roll R. In this example embodiment, the controller 900 controls the cutter actuator

710*a* to project the cutter 710 from the first drive roller 710 to cut the paper wrapping material WM from the roll R. After cutting, the first drive roller 310 and the first idle roller 320 continue to hold the paper wrapping material WM extending from the roll R.

Figure 1G:
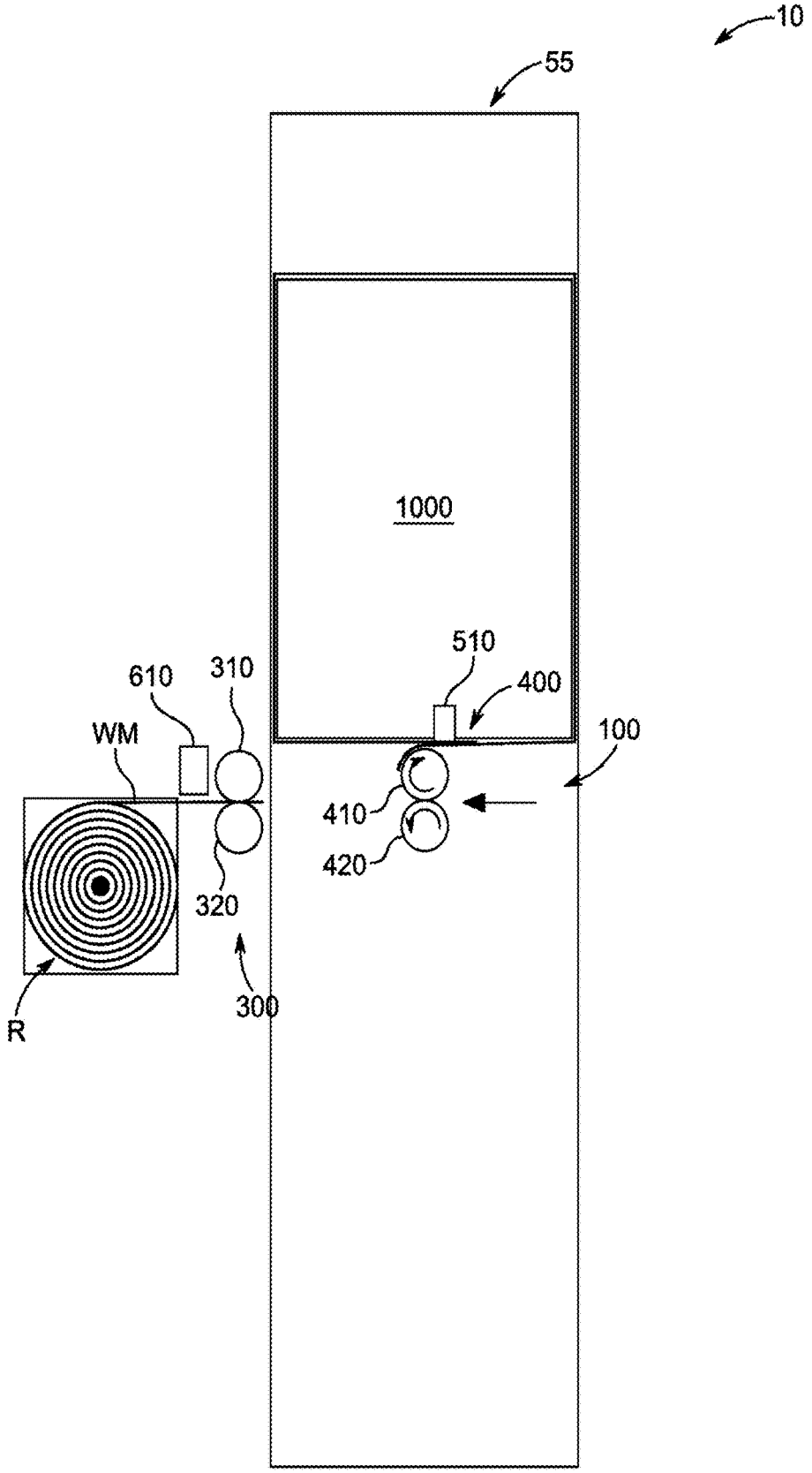

As shown in FIG. 1G, the controller 900 controls the first-roller-assembly actuator 300*a* to move the first drive roller 310 and the first idle roller 320 in the transverse direction TD from their sleeving position back to their home position near the roll R. In some embodiments, while doing so, the controller 900 controls the roll actuator 210*a* to rotate the roll R to wind any slack paper wrapping material WM onto the roll R. The controller 900 controls the second-roller-assembly actuator 400*a* to move the second drive roller 410 and the second idle roller 420 in the transverse direction TD from their home position to a sleeving position closer to the first drive roller 310 and the second idle roller 320. During this movement, the rest of the paper wrapping material WM on the second drive roller 410 unwinds and extends across the trailing surface 1000*b* of the load 1000. The second drive roller 410 is positioned relative to the load 1000 so the second drive roller 410 forces part of the unwound paper wrapping material WM against the adhesive (here, the tape T, which is no longer shown for clarity), which adheres the paper wrapping material WM to itself and completes formation of the sleeve 1000*s* around the load L.

Figure 1H:
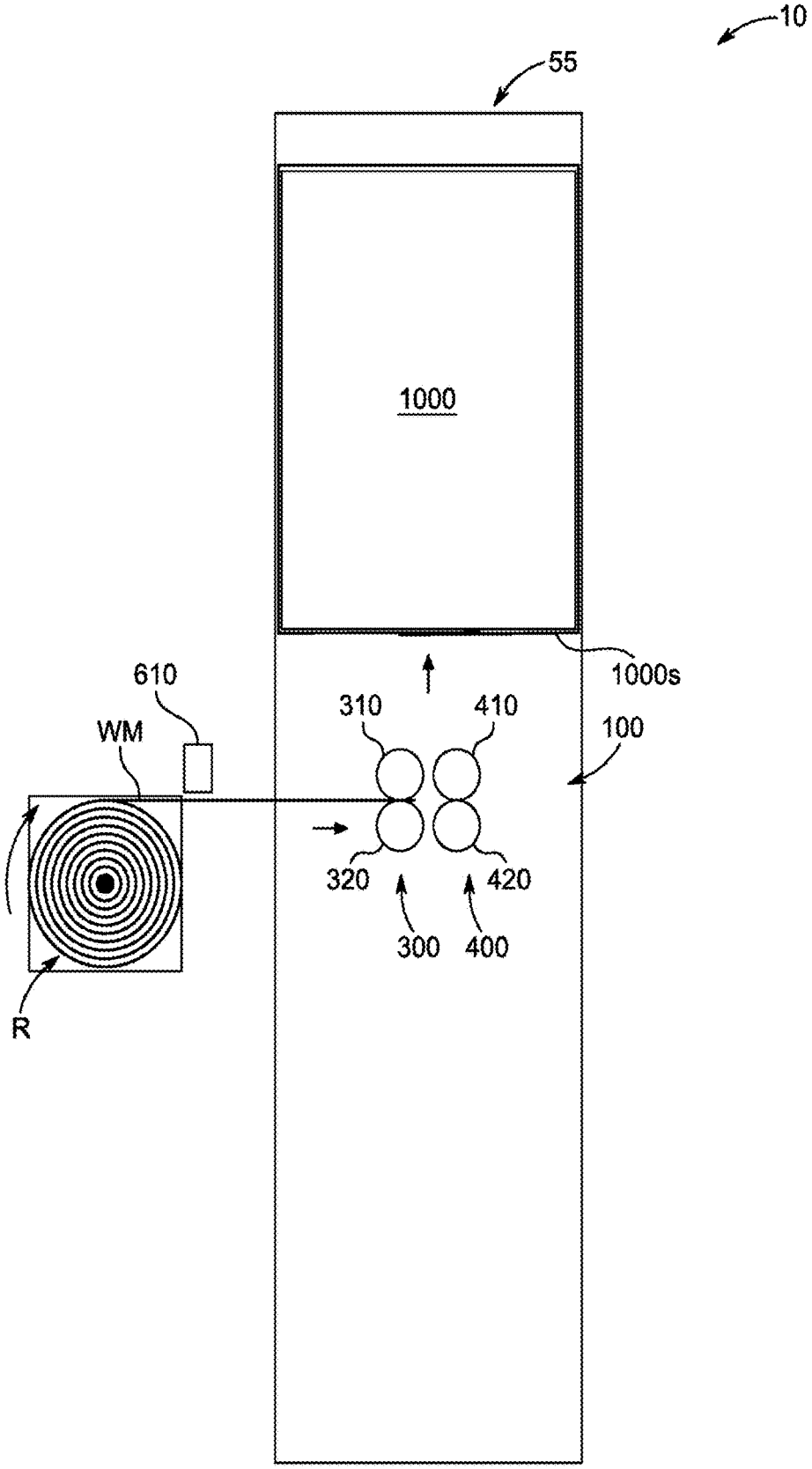

After the wrapping machine 100 has formed the sleeve, paper wrapping material WM is wrapped around the second drive roller 410 in preparation for the next wrapping cycle. As shown in FIG. 1H, the first-roller-assembly actuator 300*a* and the second-roller-assembly actuator 400*a* move the first drive and idle rollers 310 and 320 and the second drive and idle rollers 410 and 420, respectively, to respective reloading positions adjacent one another. As this occurs, the controller 900 controls the roll actuator 210*a* to rotate the roll R to unwind paper wrapping material WM from the roll R to compensate for the movement of the first drive and idle rollers 310 and 320. The controller 900 also controls the conveyor actuator 55*a* to drive the conveyor 55 to move the sleeved load 1000 in the movement direction MD.

Figure 1I:
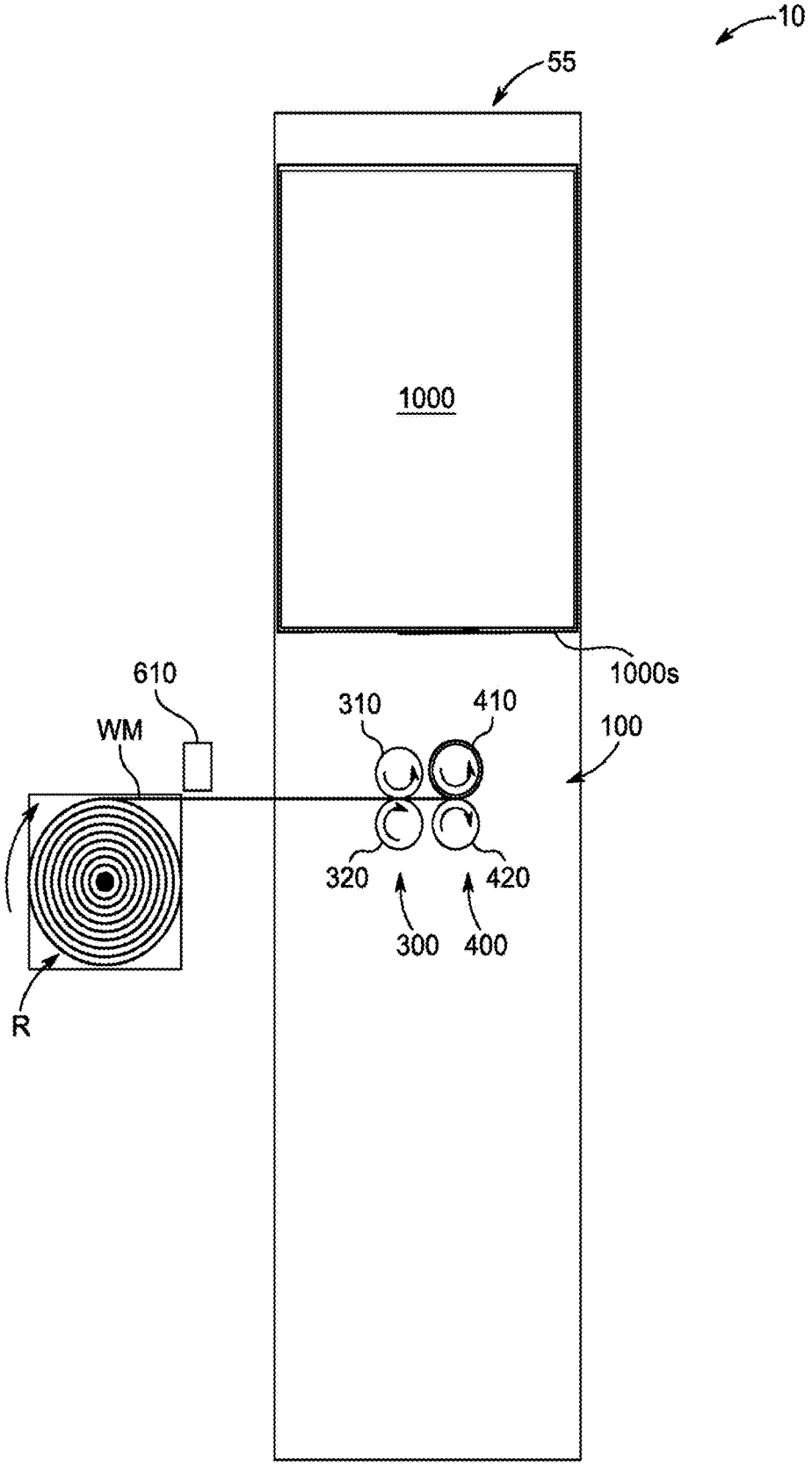
Figure 1J:
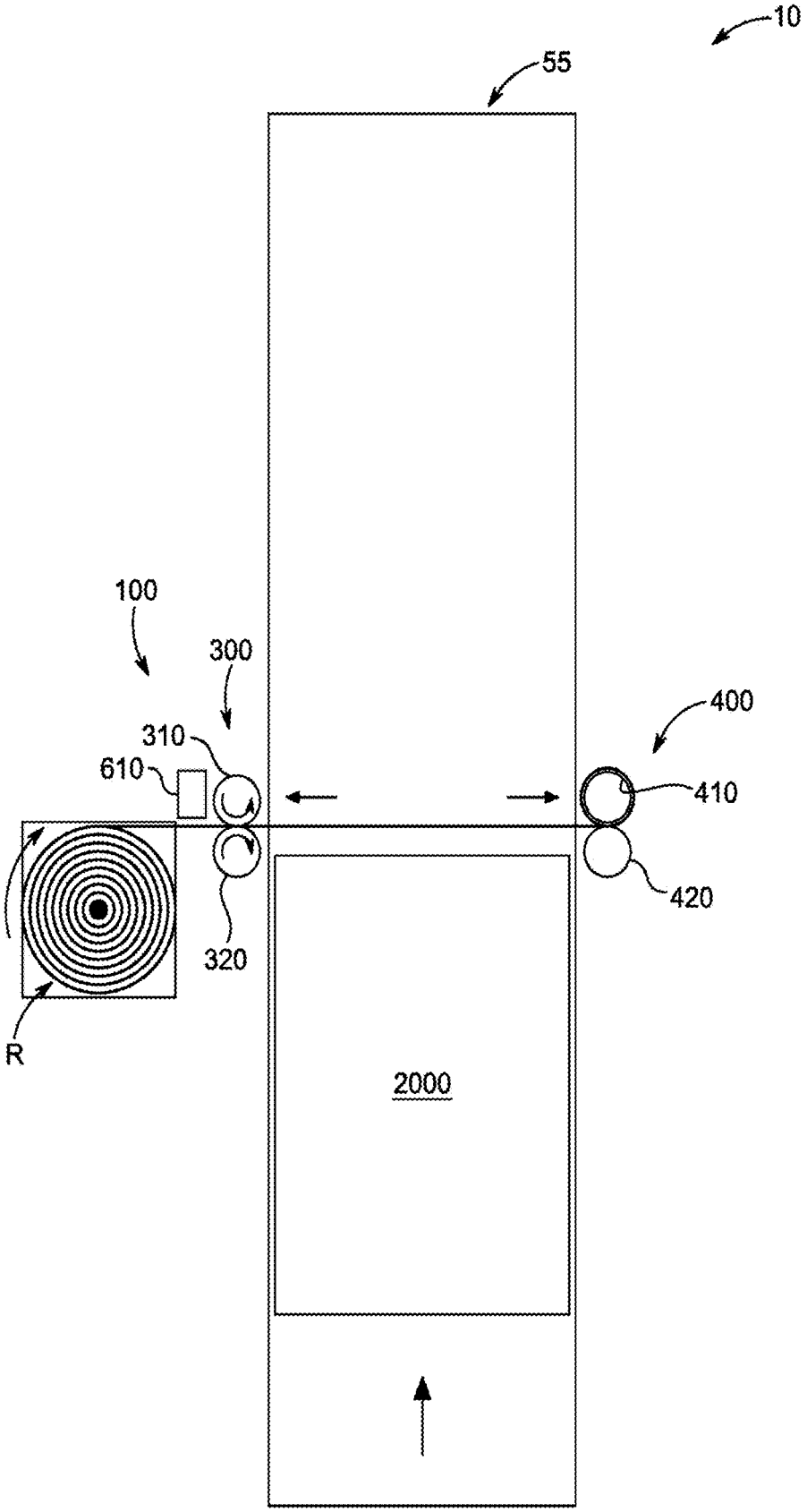

As shown in FIG. 1I, with the rollers in their reloading positions, the controller 900 controls: (1) the roll actuator 210*a* to unwind paper wrapping material WM from the roll R; (2) the first-drive-roller actuator 310*a* to feed the paper wrapping material WM to the second drive and idle rollers 410 and 420; and (3) the second-drive-roller actuator 410*a* to rotate the second drive roller 410 so the paper wrapping material WM wraps around the second drive roller 410. The controller 900 stops the actuators once the length of paper wrapping material WM wrapped around the second drive roller 410 is approximately equal to the sum of the length and half of the width of incoming load 2000 (FIG. 1J). In certain embodiments, the controller 900 controls the linear speeds of the roll R and/or the drive rollers 310 and 410 to prestretch the paper wrapping material WM during this reloading step. For instance, in one embodiment, the controller controls the roll actuator and the first-drive-roller actuator to prestretch the paper wrapping material between the roll and the first drive roller. In another embodiment, the controller controls the first-drive-roller actuator and the second-drive-roller actuator to prestretch the paper wrapping material as it moves between the two drive rollers.

As shown in FIG. 1J, the controller 900 then controls the first-roller-assembly actuator 300*a* and the second-roller-assembly actuator 400*a* move the first drive and idle rollers 310 and 320 and the second drive and idle rollers 410 and 420, respectively, back to their respective home positions in preparation for the incoming load 2000.

In certain embodiments, multiple wrapping devices are positioned in series so the conveying system can convey a load: (1) into and through a first wrapping device so the first wrapping device applies a first sleeve of paper wrapping material to the load; and then (2) into and through a second wrapping device so the second wrapping device applies a second sleeve of paper wrapping material around the first sleeve of paper wrapping material.

In certain embodiments, the wrapping system includes a top-sheet applicator configured to apply a sheet of paper wrapping material to a top surface of the load before the wrapping device forms the sleeve of paper wrapping material around the load. This enables the wrapping system to provide five-sided protection to the load. The top-sheet applicator may apply the sheet of paper wrapping material to the top surface of the load before the load reaches the wrapping device or may be integrated into the wrapping device, depending on the embodiment.

The paper wrapping material may be any suitable type of paper wrapping material, such as kraft paper, micro-creped paper, and the like. The paper wrapping material may be any suitable width and any suitable thickness, and may or may not be stretchable depending on the embodiment.

In other embodiments, the wrapping system is configured to draw other types of wrapping material, such as plastic stretch film, from a roll and form the sleeve of the wrapping material around the load of goods.

The invention claimed is:

1. A method for forming a sleeve of paper wrapping material around a load, the method comprising:

applying paper wrapping material to a leading surface of the load by engaging the leading surface with paper wrapping material extending from a paper wrapping material roll to a first roller on one side of the load and from the first roller to a second roller on an opposite side of the load;

applying paper wrapping material to opposing first and second side surfaces of the load, wherein applying paper wrapping material to the second side surface comprises unwinding part of a length of paper wrapping material wound around the second roller; and applying paper wrapping material to a trailing surface of the load to form the sleeve of paper wrapping material.

2. The method of claim 1, wherein applying paper wrapping material to the leading surface of the load comprises moving the load relative to the first and second rollers and the paper wrapping material and into engagement with the paper wrapping material.

3. The method of claim 2, wherein applying paper wrapping material to the first and second side surfaces of the load comprises moving the load relative to the first and second rollers so paper wrapping material is unwound from the roll and applied to the first side surface.

4. The method of claim 1, wherein the length of paper wrapping material wound around the second roller is greater than a length of the load.

5. The method of claim 1, further comprising, after forming the sleeve, winding a second length of paper wrapping material around the second roller.

6. The method of claim 5, further comprising driving the first roller to deliver paper wrapping material from the roll to the second roller and driving the second roller to wind the second length of paper wrapping material around the second roller.

7. The method of claim 6, further comprising driving the first and second rollers in the same rotational direction to deliver paper wrapping material from the roll to the second roller and to wind the second length of paper wrapping material around the second roller.

8. The method of claim 1, further comprising prestretching the paper wrapping material while applying the paper wrapping material to the first and second side surfaces of the load.

9. The method of claim 8, wherein applying paper wrapping material to the first and second side surfaces of the load comprises moving the load relative to the first and second rollers so paper wrapping material is unwound from the roll and applied to the first side surface.

10. The method of claim 9, wherein the second roller comprises a second drive roller, further comprising prestretching the paper wrapping material applied to the second side surface of the load by driving the second drive roller so a surface speed of the second drive roller is less than a linear speed of the load as the paper wrapping material is unwound from the second drive roller.

11. The method of claim 10, wherein the first roller comprises a first drive roller, further comprising prestretching the paper wrapping material applied to the first side surface of the load by driving the first drive roller so a surface speed of the first drive roller is less than the linear speed of the load.

12. The method of claim 11, further comprising monitoring a first rotational parameter of a first idle roller and a second rotational parameter of a second idle roller, the first idle roller biased toward the first drive roller so the paper wrapping material extends through a first nip between the first drive roller and the first idle roller, the second idle roller biased toward the second drive roller so the paper wrapping material extends through a second nip between the second drive roller and the second idle roller.

13. The method of claim 1, wherein applying paper wrapping material to the first and second side surfaces of the load comprises driving the roll via a roll actuator to unwind paper wrapping material from the roll.

14. The method of claim 1, wherein applying paper wrapping material to a trailing surface of the load to form the sleeve of paper wrapping material comprises:

applying paper wrapping material to a first portion of a trailing surface of the load opposite the leading surface of the load by moving the first roller across the first portion of the trailing surface of the load;

gripping part of the paper wrapping material applied to the first portion of the trailing surface;

cutting the paper wrapping material from the roll;

applying paper wrapping material to a second portion of the trailing surface by moving the second roller across the second portion of the trailing surface of the load and unwinding the remainder of the length of paper wrapping material from the second roller; and adhering the paper wrapping material applied to the second portion of the trailing surface to the paper wrapping material applied to the first portion of the trailing surface to form the sleeve.

15. The method of claim 14, further comprising applying an adhesive to the paper wrapping material applied to the first portion of the trailing surface; and adhering the paper wrapping material applied to the second portion of the trailing surface to the paper wrapping material applied to the first portion of the trailing surface by applying the paper wrapping material to the second portion of the trailing surface so the paper wrapping material adheres to the adhesive to form the sleeve.

16. The method of claim 15, further comprising applying the adhesive after cutting the paper wrapping material from the roll.

17. The method of claim 15, wherein applying the adhesive comprises applying tape to the paper wrapping material.

18. The method of claim 15, wherein applying the adhesive comprises applying liquid adhesive to the paper wrapping material.

19. The method of claim 14, further comprising cutting the paper wrapping material from the roll after gripping the part of the paper wrapping material applied to the first portion of the trailing surface.

* * * * *